United States Patent [19]

Eckenbach

[11] 4,197,121

[45] Apr. 8, 1980

[54] METHOD OF MAKING ELECTROPHOTOGRAPHIC IMAGES WITH A UNIFORM EXPOSURE STEP

[75] Inventor: Wolfgang Eckenbach, Gangelt, Fed. Rep. of Germany

[73] Assignee: U.S. Philips Corporation, New York, N.Y.

[21] Appl. No.: 917,975

[22] Filed: Jun. 22, 1978

[30] Foreign Application Priority Data

Jul. 2, 1977 [DE] Fed. Rep. of Germany ..... 2730051

[51] Int. Cl.[2] ..... G03G 13/16

[52] U.S. Cl. ..... 430/126; 430/89

[58] Field of Search ..... 96/1.5, 1.4, 1 R, 1.6, 96/1.7

[56] References Cited

U.S. PATENT DOCUMENTS

| | | | |
|---|---|---|---|
| 3,418,115 | 12/1968 | Menold et al. | 96/1 R |
| 3,525,612 | 8/1970 | Holstead et al. | 96/1 R |
| 3,558,308 | 1/1971 | Fletcher | 96/1 R |
| 3,781,108 | 12/1973 | Ogawa et al. | 96/1 R |
| 4,052,206 | 10/1977 | Anzai | 96/1 R |

FOREIGN PATENT DOCUMENTS

| | | | |
|---|---|---|---|
| 867668 | 5/1961 | United Kingdom | 96/1 R |

*Primary Examiner*—Roland E. Martin, Jr.
*Assistant Examiner*—John L. Goodrow
*Attorney, Agent, or Firm*—Norman N. Spain

[57] ABSTRACT

The duration of use of spectrally sensitized pigment bonding agent layers which are to be used a number of times is substantially increased by performing flood-lighting, after the development and/or transfer and prior to the recharging, with a light which is suitable per se for the image formation, but which is substantially not absorbed by the dye.

4 Claims, 2 Drawing Figures

METHOD OF MAKING ELECTROPHOTOGRAPHIC IMAGES WITH A UNIFORM EXPOSURE STEP

Figure 1:
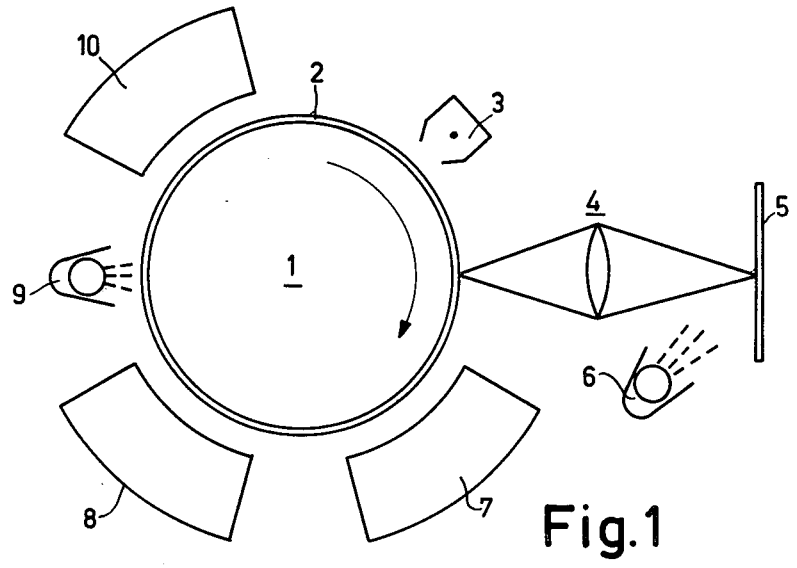

The invention relates to a method of making electrophotographic images by means of a photosensitive layer which contains inorganic photoconductive particles which are spectrally sensitized by an organic dye and which are distributed in a polymer bonding agent, comprising the following steps: the electrostatic charging of the photosensitive layer, the exposure of the layer so that a charge image corresponding to the image to be formed is produced, the development of the charge image by way of a liquid or powdery developer, the transfer of the image to a final image carrier, prior to or after the development, and subjecting the photosensitive layer to floodlighting in order to prepare it for a new cycle.

Photosensitive layers containing inorganic photoconductive particles which are spectrally sensitized by an organic dye and which are distributed in a polymer bonding agent are also referred to hereinafter as "pigment bonding agent layers". Pigment bonding agent layers containing zinc oxide as the photo conductive material are described in RCA Review 15 (1954) pages 469–484. Other suitable photoconductive materials are, for example, cadmium sulphide, titanium dioxide, zinc sulphide, zinc cadmium sulphide, zinc magnesium sulphide, cadmium selenide, zinc silicate, calcium strontium sulphide, mercury iodide, mercury oxide, mercury sulphide, indium trisulphide, gallium triselenide, arsenic trisulphide, arsenic disulphide, antimony trisulphide, arsenic triselenide, zinc titanate and lead oxide.

In order to increase the photosensitivity of the photoconductive materials into the long wavelength range, particularly from the ultraviolet into the visible range, spectral sensitizing is used, For this purpose, use is made, as has already been stated, of organic dyes which are capable of spectrally sensitizing the inorganic photoconductors. Organic dyes of this kind are, for example, rose bengal, iodeosine, trypaflavine, fluorescein, bromophenol blue, rhodamine B, alphazurine 2G and morin. Additionally suitable dyes are disclosed in U.S. Pat. Nos. 3,052,540 and 3,238,149.

Suitable polymer bonding agents are, for example, silicon resins, vinyl, acrylic acid and cellulose compounds, polystyrene, polymerized butyl methacrylate, nitrocellulose and alkyl resins. The bonding agents may also contain softening agents. In most contemporary automatic photocopying apparatus based on zinc oxide, the zinc oxide bonding agent layer is used only once; however, during recent years multiple use involving image transfer to normal paper has also become customary. The repeated charging, exposure, development and transfer are mentioned, for example, in German Offenlegungsschrift 2,432,332 and 2,432,388.

For multiple copying cycles, the dye molecules must be capable of sensitizing a number of times. The research which has resulted in the present invention, however, has demonstrated that this is hardly possible even once for the customary electrophotographic zinc oxide bonding agent layers. Said German Offenlegungsschrift 2,432,332 and 2,432,388 already mention that the photosensitivity of the known dye-sensitized photoconductive materials strongly decreases when the photoconductive materials are subjected to the combined effects of repeated charging, exposure, development and transfer when use is made of an indirect electrophotographic method. The resistance to ozone from the corona charging can be improved in accordance with the latter Offenlegungsschrift by using special dyes. However, multiple sensitizing per dye molecule cannot be readily achieved by means of these dyes.

German Offenlegungsschrift 1,958,446 indicates that it is known to heat the photosensitive layer or to irradiate this layer by infrared light in order to suppress fatigue phenomena. However, only residual potentials can be broken down by such infrared floodlighting; as regards the decrease in sensitivity, it has substantially no effect.

Therefore, German Offenlegungsschrift 1,958,446 discloses another method of regenerating photoconductive layers, i.e. a method where the total surface area is irradiated by visible light (i.e. floodlit), it being necessary to apply at the same time an electrical field which opposes the field during the corona charging. "Visible light" is to be understood to mean herein that the flood light also contains light such as used for the image formation. The simultaneous execution of two process phases i.e. floodlighting and charging, complicates the method.

In considering the German Offenlegungsschrift 1,958,446, it should be noted that therein photosensitive layers are always disclosed on which a thin-non-adhesive transparent insulating layer (for example, a polyester layer having a thickness of approximately 4 $\mu$m on a zinc oxide bonding agent layer having a thickness of approximately 50 $\mu$m) is provided. This insulating layer is probably the main cause of the rapid deterioration of the sensitivity.

German Offenlegungsschrift 2,256,327 also describes a photosensitive part provided with a high-quality electrically insulating layer. Latent electrostatic images, remaining on the high-quality electrically insulating layer after the transfer of the desired image, can be readily erased in accordance with this Offenlegungsschrift if the insulating material reacts to predetermined radiation outside the wavelength range of the radiation of the light image to be reproduced, so that it becomes photoconductive. Special ultraviolet rays are used as the rays with which the insulating layer reacts. It is to be emphasized that the method in accordance with the German Offenlegungsschrift 2,256,327 only serves for erasing latent electrostatic images which have remained on the insulating layer. Said Offenlegungsschrift does not at all concern the regenerating of the photosensitive layer, situated therebelow, with which the ultraviolet light does not penetrate.

Accordingly, the invention has for its object to provide an electrophotographic method which substantially prolongs the service life of spectrally sensitized electrophotographic layers in a simple manner.

This object is achieved in accordance with the invention in that the floodlighting in a method of the kind set forth is performed with a kind of light which is suitable per se for forming the image but which is substantially not absorbed by the dye.

The quantity of light applied during flood-lighting preferably amounts to approximately from 0.5 to 5 times the quantity of light required for the formation of the image. In principle, the quantity of light during floodlighting is subject to a lower limit, below which the effect becomes too weak, while an upper limit results from the fact that the dye starts to be destroyed because a small part of the floodlight, for example, ultraviolet light, can also be absorbed by the dye.

The wavelenghts of the light used for floodlighting in accordance with the invention are preferably situated between 250 and 520 nm. In spectrally sensitized zinc oxide bonding agent layers, the wavelengths are preferably situated between 300 and 390 nm; for spectrally sensitized cadmium sulphide bonding agent layers between 450 and 520 nm, and between 300 and 440 nm for sensitized titanium dioxide bonding agent layers. Particularly attractive wavelength ranges are from 350 to 375 nm for ZnO, 490 to 510 nm for CdS and 380 to 420 nm for $TiO_2$.

Therefore, the invention mainly consists in that the pigment bonding agent layer is irradiated, after the actual image exposure, by light (for example, having a wavelength of 370 nm for ZnO) which has a photo effect on the photoconductive pigment, but substantially none on the dye. It is not absolutely necessary that the dye absorbs absolutely no floodlight; it is sufficient if the absorption of the inorganic photoconductor is much higher so that, for example, 99% of the floodlight is captured by the photoconductor. Thus, an at least twenty-fold sensitizing reaction per dye molecule is possible. On the other hand, as has already been stated, the dye molecules in the customary pigment bonding layers can be sensitized only once on the average using the customary electrophotographic methods.

The invention is based on a photoconductive system comprising two sensitivity ranges: the dye range and the range of inorganic photoconductor. The first range serves for image exposure, while the second range serves for regeneration. For image/exposure, participation of the two ranges could be possible, i.e. it could be possible without adverse effects; however, for the floodlighting, the dye spectrum must definitely be filtered out, because absorption of this part of the light would impose an even greater burden on the dyes.

The floodlighting in accordance with the invention, following the image exposure and the development, is characterized by two conditions:

(1) The floodlight (for example, ultraviolet light having a wavelength of 365 nm for ZnO) is also suitable for image formation. In practice, the ultraviolet sensitivity of the zinc oxide is not utilized because ultraviolet light sources are not handy for the image formation and because the colour reproduction of the image is not neutral. However, this does not change the fact that this floodlight in principle forms part of the kinds of light which can be used in accordance with the invention because, as has already been defined, it is suitable per se for the image formation.

(2) The floodlight may substantially not be absorbed by the dye. Otherwise, as has already been stated, an additional burden would be imposed on the dye. This additional burden occurs notably during the known floodlighting by means of visible light.

In the preferred methods in accordance with the invention, the floodlight has a spectrum with wavelengths shorter than those of the light used for the image formation. However, the invention also covers the case where the spectrum of the floodlight includes wavelengths which are longer than those of the light used for the image formation. In that case, the described situation in which the floodlight spectrum may not include such long waves when they are situated exclusively in the infrared region must be taken into account. This is because the known infrared floodlighting systems act to break down residual potentials. As regards the said sensitivity decrease they have, as has already been stated, substantially no effect. Infrared floodlighting systems, however, are not within the scope of the present invention, because images cannot be formed by means of infrared light.

When the method in accordance with the invention is to be used for electrophotographic materials comprising an insulating cover layer, steps must be taken to ensure that the rays of the floodlight indeed reach the sensitized pigment bonding agent layer. When use is made of polyvinylcarbazol layers for the cover layers, this can be realized, for example, by way of floodlighting using light having a wavelength of 370 nm, because polyvinylcarbazol absorbs light having a wavelength of 340 nm, but transmits light having a wavelength of 370 nm.

The floodlighting in accordance with the invention serves to retard the fast sensitivity decrease of pigment bonding agent layers spectrally sensitized by dye addition, i.e. reduction of residual potentials is not concerned.

The method in accordance with the invention is based on the fact that dye-sensitized pigment bonding layers have two good sensitivity ranges in which images can be made:

(1) The UV range, from approximately 250 to 400 nm, in which, for example, ZnO itself is active as a photoconductor, (2) The visible range in which the dyes absorbed, for example, by the ZnO, are active, for example, approximately 500 to 600 nm in the case of rose bengal.

The invention offers the advantage that, while the dye concentration remains the same, a large number of copies of a photoconductive layer can be obtained. If the number of copies is kept constant, expensive dye can be saved, the adverse effects of high dye concentrations, for example, poor chargebility or fast dark discharging, also being avoided. The colour reproduction remains stable for a longer period of time in dye mixtures. The floodlighting in accordance with the invention can be performed in a simple manner by means of the floodlighting lamp already present in a conventional copying apparatus, possibly with addition of a UV band pass filter.

The invention will be described in detail hereinafter with reference to the accompanying drawing.

Figure 2:
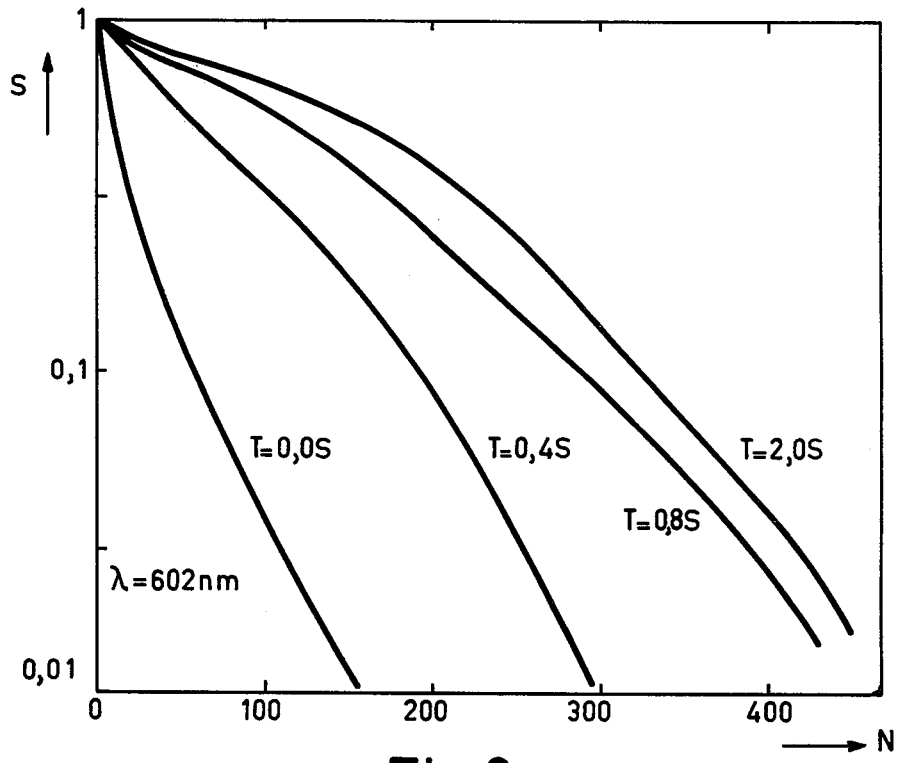

FIG. 1 is a diagrammatic view of an embodiment of a device for performing the method in accordance with the invention, and FIG. 2 shows a diagram which illustrates the dependency of the light sensitivity on the number of cycles.

The reference numeral 1 in FIG. 1 denotes a photoconductor drum whose rotatability is denoted by an arrow. The photoconductor drum is covered on the outer side by a spectrally sensitized pigment bonding agent layer 2. According to the method, this layer is guided along the following stations during rotation of the drum 1: a charging device 3, an exposure device 4 with an object 5 and an image exposure source 6, a developing device 7, a transfer device 8, a floodlighting device 9, and a cleaning device 10.

The floodlighting can also be combined with cleaning (for example, by a brush), be performed simultaneously therewith or take place after the cleaning. However, it should always take place after development and transfer and prior to the recharging.

EXAMPLE

A commercially available ZnO bonding layer (dyes: fluorescien and bromophenol blue, bonding agent on the basis of polyvinylacetate) is charged for a period of 8 seconds by way of a grid corona of −11 kV, thus assuming a surface potential of −200 V.

Subsequently, the layer is exposed to light having a wavelength of 602 nm until the surface potential has decreased to −90 V. The time required for this purpose is a measure for the photosensitivity. After that, a second exposure involving light having a wavelength of 365 nm is performed for a given period of time. For this purpose, use is made of a low pressure mercury lamp of 6 W, arranged approximately 12 cm above the layer and preceded by a UV filter. This cycle of charging and two-fold exposure is repeated a few hundred times. FIG. 2 shows how the photosensitivity S (vertically plotted on the logarithmic scale) for a wavelength $\lambda=602$ nm decreases in dependence of the number of cycles N; the parameter is the duration T of the second UV exposure. For a second UV exposure of each time 2 seconds, a sensitivity decrease by a factor 10 occurs after 325 cycles. Without second UV exposure, this decrease already occurs after 58 cycles. The effective service life of the dye has thus been increased by a ratio 325/58.

What is claimed is:

1. In an electrophotographic process of forming a multiple image comprising the steps of: electrostatically charging a photosensitive layer containing inorganic photoconductive particles, spectrally sensitized by an organic dye and which are distributed in a polymer binding agent, exposing of said layer to thereby form a charge image corresponding to the image to be formed, developing said charge image with a liquid or powdery developer, transfering said image to a final image carrier and, subsequent to the development of said charge image, uniformly exposing said photosensitive layer to light, the improvement wherein the light employed for said uniform exposure comes within a wavelength range such that said light is suitable for forming the image but is substantially not absorbed by the dye.

2. A method as claimed in claim 1, characterized in that the amount of light used during the uniform exposure amounts to from 0.5 to 5 times the amount of light required for image formation.

3. A method as claimed in claim 1, characterized in that uniform exposure is performed with light having wavelengths of between 250 and 520 nm.

4. A method as claimed in claim 3, in which the photoconductive particles of the photosensitive layer consists of zinc oxide, characterized in that the uniform exposure is performed with light having wavelengths of between 300 and 390 nm.

* * * * *